US005347922A

United States Patent [19]

Metcalf

[11] Patent Number: 5,347,922

[45] Date of Patent: Sep. 20, 1994

[54] SHELF SUPPORT SYSTEM

[75] Inventor: Derek N. G. Metcalf, LaGrange Park, Ill.

[73] Assignee: Athena Industries, Inc., LaGrange, Ill.

[21] Appl. No.: 121,165

[22] Filed: Sep. 14, 1993

[51] Int. Cl.[5] ..... A47B 9/00

[52] U.S. Cl. ..... 108/108; 211/187

[58] Field of Search ..... 108/108, 106, 109, 107; 211/153, 187

[56] References Cited

U.S. PATENT DOCUMENTS

| | | | |
|---|---|---|---|
| 676,067 | 6/1901 | Leonard | 108/109 |
| 2,732,955 | 1/1956 | Holmquist | 108/108 |
| 2,820,552 | 1/1958 | Erisalu | 108/109 |
| 3,234,897 | 2/1966 | Berk | 108/108 X |
| 3,528,558 | 9/1970 | Williams . | |
| 3,601,256 | 8/1971 | Bowers, Jr. | 211/187 X |
| 3,640,389 | 2/1972 | Snyder | 211/187 |
| 3,643,808 | 2/1972 | Ryan et al. . | |
| 3,672,624 | 6/1972 | Keller | 108/108 X |
| 3,896,718 | 7/1975 | Giambalvo | 108/108 |
| 4,492,169 | 1/1985 | Ware et al. | 108/108 X |
| 4,501,369 | 2/1985 | Fox | 211/187 X |
| 4,565,725 | 1/1986 | Spamer et al. . | |
| 4,706,820 | 11/1987 | Spamer et al. . | |
| 4,771,898 | 9/1988 | Howard et al. . | |
| 4,809,855 | 3/1989 | Bustos . | |
| 4,932,538 | 1/1990 | Gambello . | |
| 4,951,817 | 8/1990 | Moransais . | |

FOREIGN PATENT DOCUMENTS

| | | | |
|---|---|---|---|
| 666765 | 9/1964 | Italy | 108/107 |
| 278526 | 1/1952 | Switzerland | 211/136 |

*Primary Examiner*—José V. Chen

*Attorney, Agent, or Firm*—McCaleb, Lucas & Brugman

[57] ABSTRACT

A merchandise display rack employing spaced two tubular uprights of quadrangular cross section having one wall provided with connector openings each receptive of a single connector pin extending outwardly from the outer ends of parallel tubular arms of quadrangular cross section associated with a shelf structure; the connector pins causing the outer ends of the tubular arms to tightly abut the uprights and provide a stable cantilever support for the shelf structure when the latter is horizontally positioned.

7 Claims, 2 Drawing Sheets

SHELF SUPPORT SYSTEM

This invention is directed to shelf support systems and more particularly to a new and improved organization of parts for detachably connecting shelf structures to upright supports.

BACKGROUND OF THE INVENTION

Free standing and/or wall mounted display racks, with which the present invention has been found useful, are familiarly employed in self service stores for displaying and merchandising a great variety of consumer products. Many of such display racks provide a plurality of pegs from which packaged articles are suspended. In other instances heavy or bulky items are displayed on open horizontal trays or shelves usually supported by two or more cantilever supporting arms attached to vertical upright supports or, in other instances, attached to peg boards or peg bars. In general, experience has demonstrated that the typical known cantilever arm supported shelf systems are quite unstable and prone to accidental collapse or distortion, particularly if struck by a passing stock cart or bumped into by a customer. In other instances, it has been found that efforts to stabilize and rigidify the shelf supporting cantilever support arms has so complicated the means for securing them to the upright supports that their assembly and disassembly is prohibitively inconvenient and time consuming. Consequently, there exists a realistic need for an improved cantilever shelf mounting system, particularly useful for merchandise displays and like shelf uses.

BRIEF DESCRIPTION OF INVENTION

This invention is directed to an improved, simplified and dependably operable shelf supporting system which obviates the aforenoted problems and shortcomings of the prior art.

Briefly, this invention comprises a improved, lightweight, rugged shelf structure employing a three sided tubular frame of quadrangular cross section bordering a planar shelf. The open ends of the frame's tubular side rails are each fitted with a single upturned L-shaped connector pin having one arm fixed to the inside top wall of the tubing and the other arm or leg projecting upwardly past the outer end of the top wall of the associated side rail for insertion into an opening formed in a tubular upright support. Once the connector pins are inserted into the upright openings, downward pivotal movement of the shelf structure about the connector pins causes the open ends of the tubular side rails to tightly abut the adjacent faces or walls of laterally spaced upright supports in which the connector openings are formed. Loading the tray serves to increase contact between the shelf frame and the upright supports. The quadrangular dimensions of the frame side rails and their full end engagement with the exterior walls of the supports while the connector pins engage the opposite sides of such walls, provides a very strong and stable cantilever assembly.

It is an important object of this invention to provide a new and improved combination for cantilever mounted shelf structures.

Another important object of this invention is to provide a simple, operationally effective and stable means for detachably interconnecting a pair of tubular members in predetermined angular relationship.

Still another object of this invention is to provide a simple, operationally stable free standing or wall mounted shelf assembly.

A still further object of this invention is to provide a shelf assembly according to the proceeding object which is characterized by economies of manufacturer and operational reliability and is particularly adapted to merchandise displays.

Having described this invention, the above and further objects, features and advantages thereof will be recognized from the following description of a preferred embodiment thereof illustrated in the accompanying drawings and representing the best mode presently contemplated for enabling those skilled in the art to practice this invention.

Figure 1:
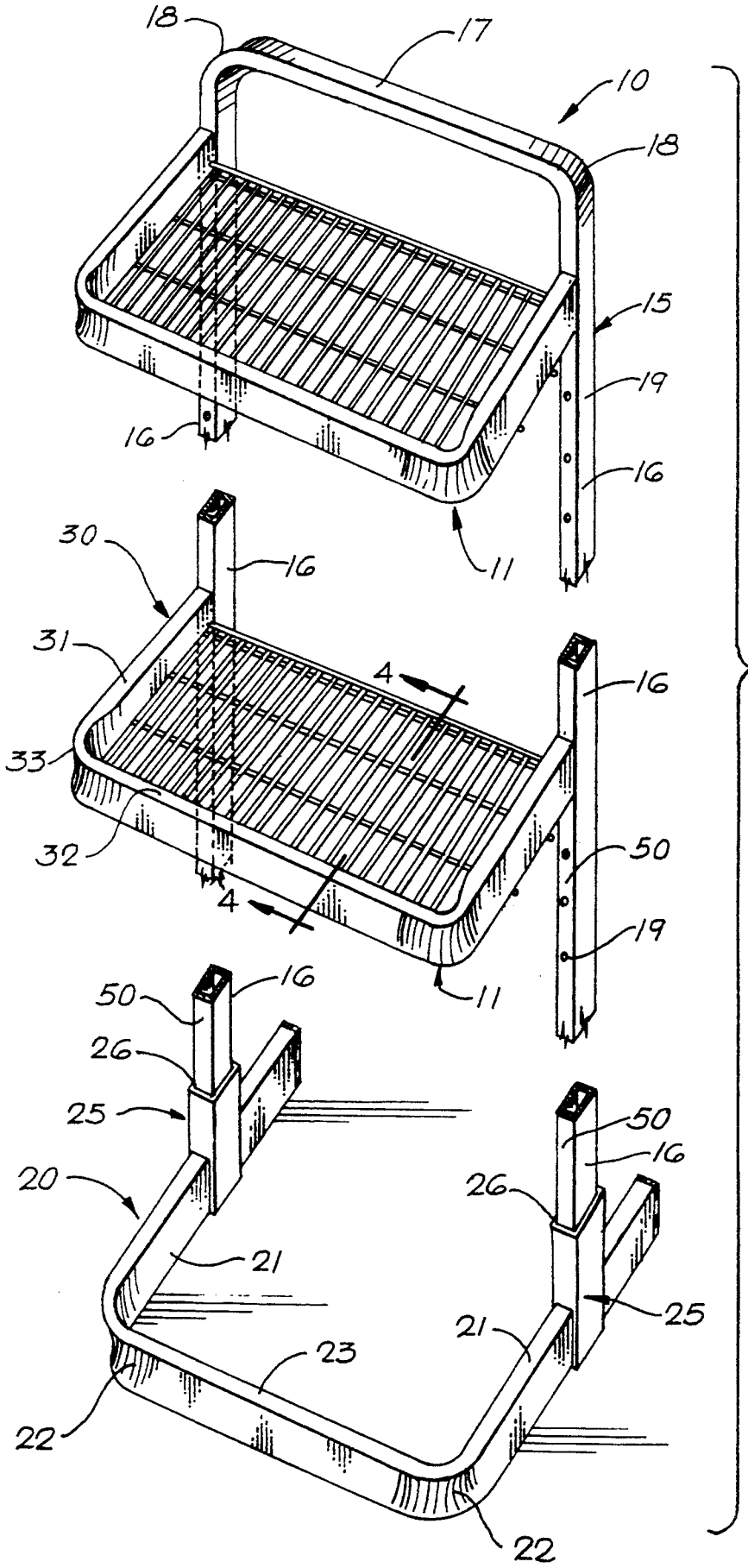
FIG. 1 is a perspective view of display rack with foreshortened vertical support members for supporting multiple cantilever mount shelf structures according to this invention.
Figure 2:
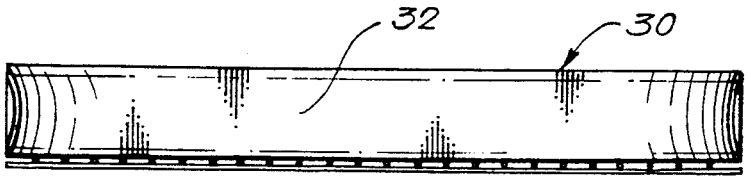
FIG. 2 is a front elevational view of a shelf structure illustrated in FIG. 1.
Figure 3:
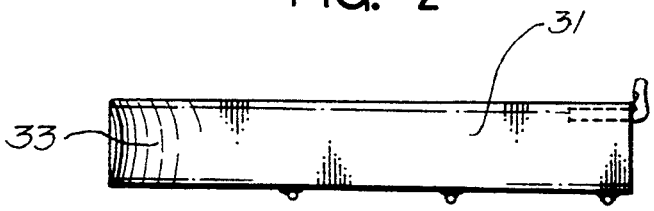
FIG. 3 is a right hand side elevational view of the shelf structure shown in FIG. 1.
Figure 7:
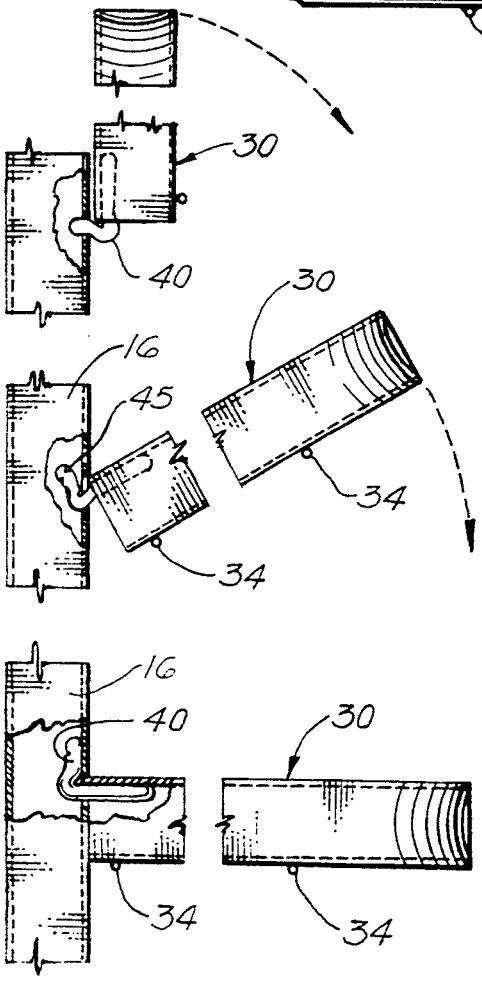
Figure 6:
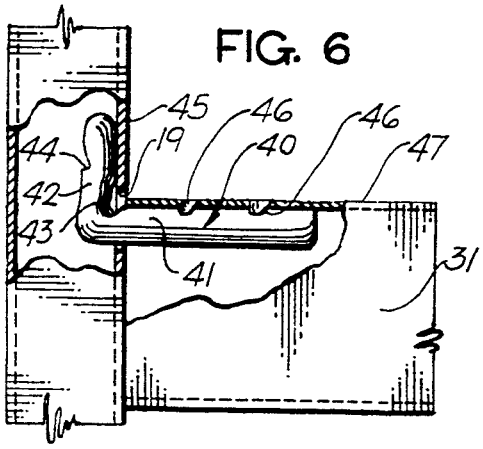

FIG. 6 is an enlarged partial side elevational view, with parts broken away in section, of the connective means employed for attaching a shelf structure to an upright support of the display rack seen in FIG. 1; and FIG. 7 is a schematic view, with portions broken away in section, illustrating the operational procedure involved in mounting a shelf structure on the vertical support members of the display rack shown in FIG. 1.

DESCRIPTION OF THE PREFERRED EMBODIMENT

With initial reference to FIG. 1, it will be recognized that a free standing vertical display rack 10 is therein illustrated for supporting one or more horizontal, cantilever mounted shelf structures 11, 11.

In general, rack 10, is formed of metal tubing preferably having a quadrangular cross section, either square or rectangular, suitably bent to provide a support section 15 of generally U-shaped configuration to include a pair of parallel, linear support members 16, 16 which are interconnected at one end by a cross rail 17. Junction between the support members and cross rail is effected by integral radial bends forming corners 18, 18. It will be understood that rail 17 is oriented at right angles to the support members 16 and that in normal operation support section 15 is vertically upright with the cross rail 17 at its upper end horizontally oriented. Suitable spaced connector openings 19, 19 are formed in corresponding walls of members 16 to which shelves are to be attached.

A U-shaped base section 20 is also provided to present a stable ground engaging platform for the support section. As such section 20 comprises a pair of parallel spaced side arms 21, 21, joined at one end via integral radial corner portions 22, 22 with a cross connecting front rail 23, similar to the construction of support section 15.

Interconnection of the two sections 15 and 20 is brought about by tubular brackets 25, 25 which embrace and are welded to the arms 21 of the base section, in upright or right angled relation thereto, as shown in FIG. 1. The brackets 25 are short lengths of quadrangular cross section tubing presenting interior mounting sockets having open upper ends 26 for intermatingly receiving lower end portions of support section members 16, 16 with close fitting engagement and which may be welded in place, if desired.

It is to be understood that although rack 10 is herein shown as floor engaging, the support members 16 also may be attached directly to a vertical wall support, if desired, in lieu of the illustrated base section 20 and the U-shaped support section 15.

With reference to FIGS. 1–6, features of the shelf structures 11, 11 are illustrated. As shown each shelf structure includes a three sided U-shaped border railing 30 having parallel side rails 31, 31 interjoined at one operationally outer end to a front rail 32 by integral intervening corner bends 33, 33. This railing is formed of tubular metal shown herein having a quadrangular cross section. Preferably, this quadrangular section is rectangular having long side walls and shorter top and bottom walls to match the cross section of uprights 16 for reasons which will appear presently. It also is to be noted that the railing is formed with its longer walls oriented to be operationally upright or vertical. It further is to be noted (see FIG. 1) that the radiused corners 33 are purposely squeezed or narrowed laterally by virtue of the radius bends to deform the long tubular side walls toward one another. This results in rigidifying and strengthening the corners of railing 30.

In order to provide shelf support, a plurality of parallel heavy wire rods 34 are welded to the underside of the side rails 31, 31, as shown best in FIG. 1. It will be noted that one rod 34 extends across the side rails 31 of railing 30 adjacent the open side of its U configuration. This rod is spaced registeringly beneath a superposed rod 35 that extends between the inside opposing face 36 of the side rails 31 (see FIG. 5). Smaller wire rods 37, 37 are welded transversely to the upper side of the rods 34 with the outer ends thereof welded to the underside of the front rail 32 and to the underside of the superposed rod 35. This structure forms an open supporting grid bordered by the railing 30 to provide a tray like shelf capable of undersupporting merchandise loads.

Figure 4:
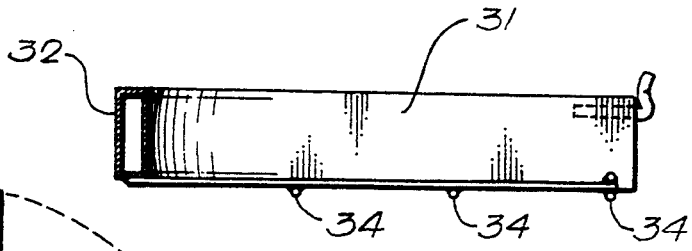
FIG. 4 is a cross sectional view of the shelf structure shown in FIGS. 1–3, taken substantially along vantage line 4—4 of FIG. 1 and looking in the direction of the arrows thereon.
Figure 5:
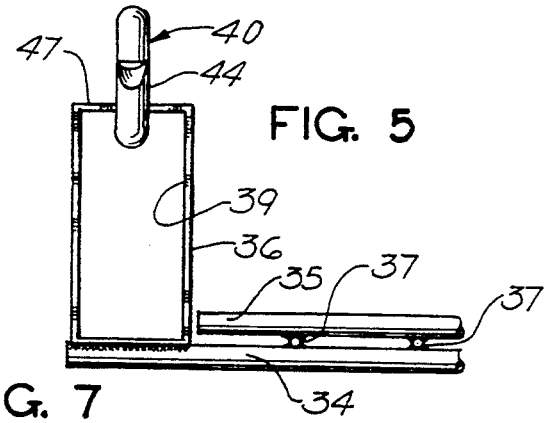
FIG. 5 is a partial enlarged end elevational view of the right hand side of the tray structure shown in FIGS. 1–4.

In order to connect the shelf structures 11 to their associated upright supports 16, the open rear ends 39 of the railing side rails 31, which are co-planar and shown herein at right angles to the longitudinal axes of rails 31, are each fitted with a single connector pin 40 (see FIGS. 4, 5 and 6). Optionally the plane of ends 39 may be at an acute angle to the rails 31, along with appropriate orientation of the connector pins, if downwardly sloping shelves are desired.

The connector pins 40 are generally L-shaped and of cylindrical metal rod material, as shown best in FIGS. 4–7. Notably each pin comprises a long arm 41 and a short leg 42 which are integral and generally at right angles, being defined at their inner by a major bend 43. The short leg 42 is further upset and reversely bent at 44 adjacent its rounded free end whereby to offset face 45 thereof into co-planar alignment with the pin's major bend 43. This configuration of leg 42 materially alleviates any tendency of the connector pin to break or bend at its major bend 43 when under load.

It will be noted that the long arm 41 of each pin 40 is secured by spot welds 46 to the underside of the top wall 47 of the railing side rails 31 (see FIG. 6) so that the short leg of each connector pin extends above the plane of side rail wall 47 with face 45 of the pin spaced axially outwardly from the open end 39 thereof a distance substantially equal to the wall thickness of the associated tubular upright 16. Thus when the pins 40 are inserted into selected corresponding openings 19 in the support frame uprights 16, as shown in FIG. 7, and subsequently pivoted therein by lowering the shelf structure 11 downwardly, the arms 41 engage the walls of opening 19 and faces 45 of the connector pins tightly engage the inside faces of the upright walls 50 in which openings 19 are formed (see FIG. 7).

Importantly, when the tray shelves hereof are in their mounted positions as indicated in schematic FIG. 7, the ends of the side rails of the shelf railing 30 are tightly abutted against the outer face of the upright front walls 50. Thus, the vertical dimension of the railing side rails 31 provide a lever advantage undersupport to the shelf structure to effect a vertically stable support therefor. Similarly the abutting engagement of the top and bottom walls and vertical side walls of rails 31 with the walls 50 of the upright supports 16, produces secure lateral stability to the shelf structures in keeping with that objective of this invention.

From the foregoing it is believed that those familiar with the art will readily recognize the improved advancement of this invention and will appreciate that while the same has been described above in association with a preferred embodiment thereof illustrated in the accompanying drawings, the same is subject to variations, modifications and substitutions of equivalents without departing from the spirit and scope of the invention which is defined in the following appended claims.

The embodiments of the invention in which an exclusive property or privilege is claimed are defined as follows:

1. A support system for cantilever mounted shelves, comprising:

a pair of laterally spaced, vertically upright, tubular supports of quadrangular cross section formed with a plurality of spaced connector openings in corresponding co-planar front walls thereof;

a cantilevered shelf structure extending between and detachably secured to said front walls at selected vertical position comprising a planar shelf and a generally U-shaped tubular railing fixed to and bordering front and side margins of said shelf;

said railing comprising a pair of like, laterally spaced tubular side rails having co-planar aligned ends disposed transversely adjacent a rear margin of said shelf for confronting said front walls of said supports;

a pair of rigid, generally L-shaped connector pins, one associated with each of said side rails; each of said pins comprising an arm and a transversely related leg at one end of said arm, said arm being fixed to one of said ends of said rails so that the leg thereof is spaced axially outwardly of said one of said ends and extends transversely past a top wall of an associated said side rail for insertion into a selected one of said connector openings whereby said shelf structure is pivotally coupled to said vertical supports and is moveable about said pins until said co-planar ends of said side rails abut the exterior of said front walls and said connector pins engage the interior thereof to effect vertically and laterally stable cantilever support of said shelf structure.

2. The combination of claim 1, wherein said supports and said railing are constructed of tubing with like quadrangular cross sections.

3. The combination of claim 1, wherein said planar shelf is quadrangular, said railing borders three margins of said shelf and said rear margin of said shelf is open.

4. The combination of claim 2, wherein said railing is formed of metal tubing with a rectangular cross section, the longer sides of said cross section being oriented vertically when said shelf is mounted on said supports.

5. The combination of claim 3, wherein each L-shaped connector pin is unitary and characterized by a major angular bend between said leg and arm thereof; said leg having its terminal end aligned to interiorly engage a related one of said front walls when said shelf structure is cantilever mounted on said supports.

6. The combination of claim 5, wherein said one leg and arm are oriented at right angles to one another.

7. The combination of claim 1, wherein said co-planar ends of said side rails are open, and each of said L-shaped connector pins is mounted with a longer arm extending into the interior of its associated side rail and said leg thereof oriented at an angle to said longer arm exteriorly of said side rail.

* * * * *